US009168738B2

(12) United States Patent
Otsuka et al.

(10) Patent No.: US 9,168,738 B2
(45) Date of Patent: Oct. 27, 2015

(54) LIQUID DISCHARGE APPARATUS AND METHOD OF DISCHARGING LIQUID

(71) Applicant: SEIKO EPSON CORPORATION, Tokyo (JP)

(72) Inventors: Shuji Otsuka, Nagano (JP); Tadashi Kiyuna, Tokyo (JP); Toshifumi Asanuma, Tokyo (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/221,846

(22) Filed: Mar. 21, 2014

(65) Prior Publication Data

US 2014/0285552 A1 Sep. 25, 2014

(30) Foreign Application Priority Data

Mar. 22, 2013 (JP) ..... 2013-059506

(51) Int. Cl.
*B41J 29/38* (2006.01)
*B41J 2/045* (2006.01)

(52) U.S. Cl.
CPC ..... *B41J 2/04588* (2013.01); *B41J 2/04506* (2013.01); *B41J 2/04541* (2013.01); *B41J 2/04581* (2013.01)

(58) Field of Classification Search
CPC ..... B41J 2/04581; B41J 2/04588; B41J 2/04541; B41J 2/04593; B41J 2/0458
USPC ..... 347/10
See application file for complete search history.

(56) References Cited

U.S. PATENT DOCUMENTS

| | | | | |
|---|---|---|---|---|
| 5,790,139 | A * | 8/1998 | Umeno et al. | 347/10 |
| 7,852,128 | B2 | 12/2010 | Kitazawa et al. | |
| 2002/0033852 | A1 * | 3/2002 | Chang | 347/9 |
| 2011/0237700 | A1 * | 9/2011 | Miyabayashi | 522/64 |

FOREIGN PATENT DOCUMENTS

| | | | |
|---|---|---|---|
| JP | 2009-123456 | A | 6/2009 |
| JP | 2009-190287 | A | 8/2009 |
| JP | 2010-114711 | A | 5/2010 |

* cited by examiner

*Primary Examiner* — Manish S Shah
*Assistant Examiner* — Yaovi Ameh
(74) *Attorney, Agent, or Firm* — Global IP Counselors, LLP

(57) ABSTRACT

A liquid discharge apparatus includes an actuator element configured and arranged to receive a drive signal to discharge a liquid, the liquid being an ink including 0.1 wt % to 10 wt % of a polar solvent. The waveform of the drive signal supplied to the actuator element includes a non-rectangular shaped pulse with a ripple being formed in a falling portion of the non-rectangular shaped pulse.

7 Claims, 15 Drawing Sheets

| Material type | Material name | Sample S1 | Sample S2 | Sample S3 |
|---|---|---|---|---|
| Pigment | Carbon black | 2.5 | 5 | 4 |
| Organic solvent | 1,2-hexanediol | 5 | 5 | 5 |
| | 2-pyrrolidone | 15 | 2 | 2 |
| | Triethylene glycol monobutyl ether | 1 | 1 | 3 |
| | Glycerol | - | 10 | 10 |
| | Propylene glycol | 10 | 2 | 5 |
| Resin | Styrene-acrylate resin emulsion A (Tg 60°C: glass transition temperature high) | 2 | - | - |
| | Styrene-acrylate resin emulsion B (Tg 0°C: glass transition temperature low) | - | - | 1.5 |
| | Polyethylene wax | 0.5 | - | - |
| | Urethane resin emulsion (stretchability high) | 0.5 | 6 | - |
| Surfactant | Silicon-based surfactant | 0.5 | 1 | 1 |
| Antifoamer | Acetylene glycol-based antifoamer | 0.2 | 0.2 | 0.2 |
| pH adjuster | Triethanolamine | 0.2 | 0.2 | 0.2 |
| Water | Pure water | Remainder | Remainder | Remainder |
| Total | | 100 | 100 | 100 |

Fig. 4

| $V_{out}$ | Comparator 38 | | | | | Level shifter 36 | | | | | |
|---|---|---|---|---|---|---|---|---|---|---|---|
| | First | Second | Third | Fourth | Fifth | First | Second | Third | Fourth | Fifth | Sixth |
| $0 - V_H/6$ | L | L | L | L | L | E | D | D | D | D | D |
| $V_H/6 - 2V_H/6$ | H | L | L | L | L | D | E | D | D | D | D |
| $2V_H/6 - 3V_H/6$ | H | H | L | L | L | D | D | E | D | D | D |
| $3V_H/6 - 4V_H/6$ | H | H | H | L | L | D | D | D | E | D | D |
| $4V_H/6 - 5V_H/6$ | H | H | H | H | L | D | D | D | D | E | |
| $5V_H/6 - V_H$ | H | H | H | H | H | D | D | D | D | D | E |

Fig. 6

LIQUID DISCHARGE APPARATUS AND METHOD OF DISCHARGING LIQUID

CROSS-REFERENCE TO RELATED APPLICATIONS

This application claims priority to Japanese Patent Application No. 2013-059506 filed on Mar. 22, 2013. The entire disclosure of Japanese Patent Application No. 2013-059506 is hereby incorporated herein by reference.

BACKGROUND

1. Technical Field

The present invention relates to a liquid discharge apparatus and a method of discharging a liquid.

2. Related Art

An inkjet printer is known, with which ink is discharged onto a print medium from a plurality of nozzles provided to a print head. With the inkjet printer, actuators element provided so as to correspond to each of the nozzles of the print head are driven in conformity with a drive signal supplied from a drive circuit, and the ink is thereby discharged from the nozzles.

Because a capacitive element, such as a piezo element, is utilized as the actuator elements of the print head, driving the actuator elements requires an ample supply of electrical current. For this reason, the inkjet printer of such description is provided with a current amplifier circuit for amplifying the current of the drive signal. Known as such a current amplifier circuit are: a linear amplifier circuit, such as a class AB amplifier circuit, with which an input signal is amplified by an amplification element without alteration; and a non-linear amplifier circuit, such as a class D amplifier circuit, with which pulse width modulation or pulse density modulation are applied to amplify the current with a switching circuit. In general, a non-linear amplifier circuit has an advantage over a linear amplifier circuit in that less power is consumed. For example, see Japanese Laid-open Patent Publication 2009-123456, Japanese laid-open patent publication 2009-190287 and Japanese laid-open patent publication 2010-114711.

SUMMARY

However, there remains room for improvement in printers provided with a non-linear amplifier circuit.

In order to resolve at least in part the above-mentioned problem, the present invention can be implemented as the following aspects.

(1) A liquid discharge apparatus according to one aspect includes an actuator element configured and arranged to receive a drive signal to discharge a liquid, the liquid being an ink including 0.1 wt % to 10 wt % of a polar solvent. The waveform of the drive signal supplied to the actuator element includes a non-rectangular shaped pulse with a ripple being formed in a falling portion of the non-rectangular shaped pulse.

According to this configuration, the ink discharged by the liquid discharge apparatus contains 0.1 wt % to 10 wt % of a polar solvent, in order to increase the viscosity, and therefore even though the waveform of the drive signal includes the ripples, it is possible to suppress discharge operations during a single instance of which a plurality of ink droplets are discharged or after which the ink droplets are separated into a plurality. This makes it possible to suppress the occurrence of failures of the inkjet printer or deterioration in the image quality of the printed images. Because the waveform of the drive signal does include the ripples, however, the actuator element experiences a minute acceleration/deceleration, and therefore it is possible to minimize the inertia that acts on the actuator element immediately after a cavity volume is contracted as a discharge operation. This makes it is possible to suppress an increase, caused by excess (overshooting) of the actuator element immediately after the discharge operation, in the amount of ink discharged. Also, when the discharge operation includes minute fluctuations, then minute fluctuations in the amount of deformation of the actuator element or a minute variance in the volume of a cavity, of each individual printer, can be absorbed. That is to say, it is possible to suppress a variance in the discharged amount caused by manufacturing errors.

(2) The liquid discharge apparatus of the above aspect may further includes an auxiliary power source circuit serving as a power supply source, and an amplifier circuit configured to use power supplied from the auxiliary power source circuit to current-amplify an inputted original drive signal and generate the drive signal. The amplifier circuit may be configured to current-amplify the original drive signal, with which the ripple is not formed in the waveform, to generate the drive signal with which the ripple is formed in the waveform. According to this configuration, it is possible to form the ripples in the waveform of the drive signal.

(3) The liquid discharge apparatus of the above aspect may have a configuration in which the amplifier circuit includes a plurality of unit amplifier circuits respectively connected to both the auxiliary power source circuit and the actuator element, and among the unit amplifier circuits, one or two unit amplifier circuits are configured to supply a current to the actuator element using the auxiliary power source circuit as a source of supply of the current, in accordance with a voltage of a side that is connected to the actuator element.

According to this configuration, it is possible to form the ripples in the waveform of the drive signal, because the unit amplifier circuit that is operating is switched in accordance with the voltage of the actuator element-side when the drive signal is being current-amplified. Also, because the unit amplifier circuit that is operating is switched in accordance with the voltage of the actuator element-side, it is possible to minimize the energy that is lost during charging and discharging of the actuator element. This makes it possible to minimize the power consumed by the liquid discharge apparatus.

(4) In the liquid discharge apparatus of the above aspect, the amplifier circuit may be a class D amplifier circuit. According to this configuration, because the liquid discharge apparatus current-amplifies the drive signal using a non-linear amplifier circuit, it is possible to form the ripples in the waveform of the drive signal. it is also possible to minimize the power consumed in comparison to a liquid discharge apparatus that uses a linear amplifier circuit.

(5) In the liquid discharge apparatus of the above aspect, the ink may include hexanediol. According to this configuration, it is possible to further increase the discharge stability of the ink in the liquid discharge apparatus.

(6) In the liquid discharge apparatus of the above aspect, the ink may include at least a colorant, a photopolymerizable resin, a photopolymerization initiator, and the polar solvent. The photopolymerizable resin may include oligomer particles in an emulsion state and monomer present in the oligomer particles. The polar solvent may include one or more species among 2-pyrrolidone, N-acryloyl morpholine, and N-vinyl-2-pyrrolidone. According to this configuration, it is possible to further increase the print stability of the liquid discharge apparatus.

(7) A method of discharging a liquid according to another aspect includes discharging a liquid by supplying a drive signal to an actuator element, the liquid being an ink comprising 0.1 wt % to 10 wt % of a polar solvent. A waveform of the drive signal supplied to the actuator element including a non-rectangular shaped pulse with a ripple being formed in a falling portion of the non-rectangular shaped pulse.

According to this configuration, the ink discharged contains 0.1 wt % to 10 wt % of a polar solvent, in order to increase the viscosity, and therefore even though the waveform of the drive signal includes the ripples, it is possible to suppress discharge operations during a single instance of which a plurality of ink droplets are discharged or after which the ink droplets are separated into a plurality. Because the waveform of the drive signal does include the ripples, however, it is possible to suppress an increase in the discharged amount caused by overshooting of the actuator element immediately after a discharge operation. It is also possible to suppress a variance in the discharged amount caused by manufacturing errors.

There are a variety of forms with which the present invention can be implemented. For example, it would be possible to implement the present invention in such forms as a drive circuit and drive method for driving a liquid discharge head, a method for controlling a liquid discharge apparatus, a print apparatus and print method for printing by discharging a liquid, a computer program for implement the functions of these methods or apparatuses, or a recording medium in which the computer program is recorded.

BRIEF DESCRIPTION OF THE DRAWINGS

Referring now to the attached drawings which form a part of this original disclosure:

FIG. 4 is a descriptive drawing illustratively exemplifying the components of ink used in the printer of the present embodiment; the ink indicated as the sample S1 contains 1,2-hexanediol 2-pyrrolidone triethylene glycol monobutyl ether propylene glycol, serving as a polar solvent;

FIG. 6 is a descriptive drawing for describing the relationship between an output voltage Vout and the operations of a comparator and level shifter;

DETAILED DESCRIPTION OF EXEMPLARY EMBODIMENTS

A. First Embodiment

Figure 1:
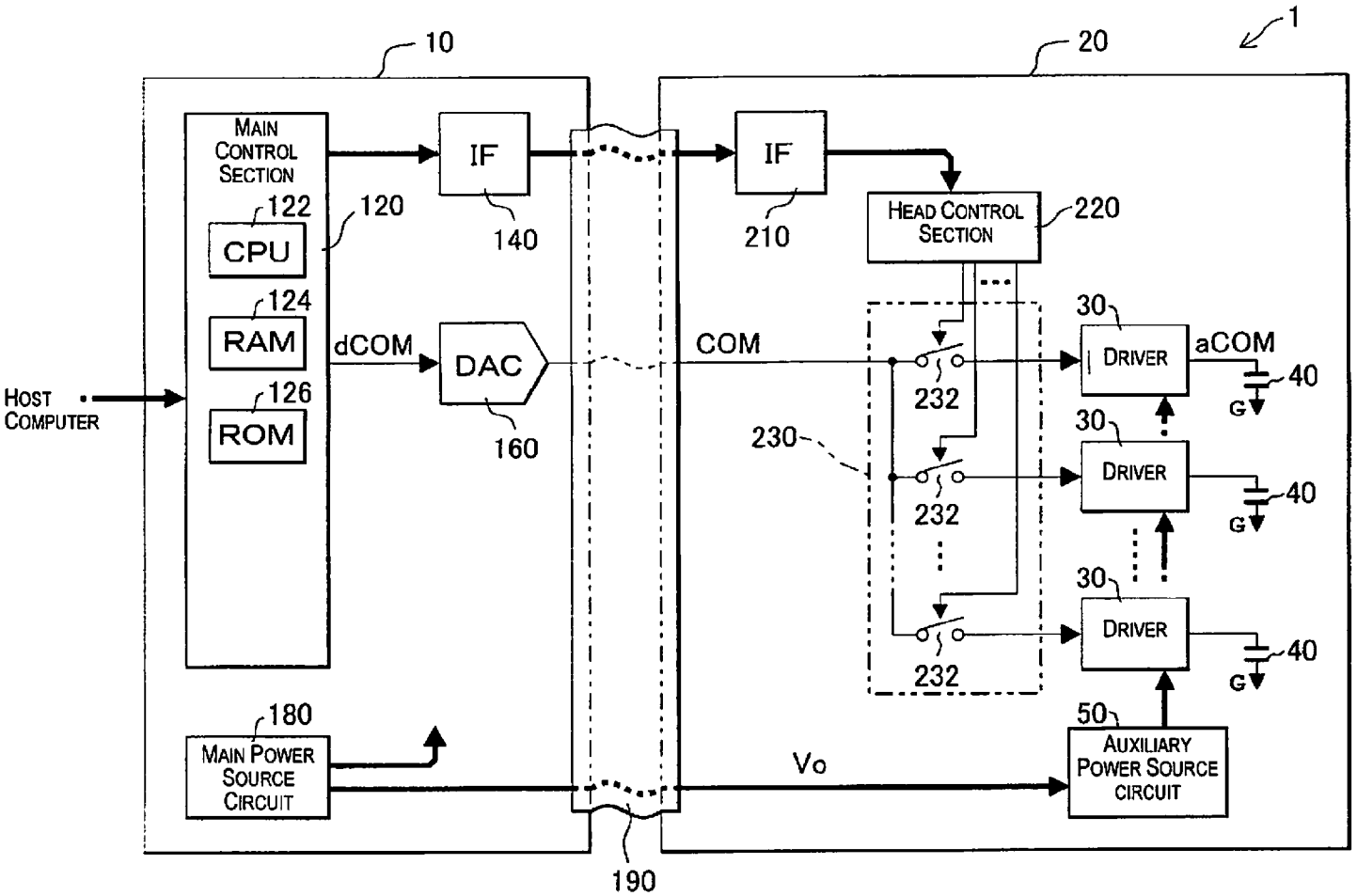
FIG. 1 is a block diagram illustrating a schematic configuration of a printer serving as one embodiment of the present invention.

FIG. 1 is a block diagram illustrating a schematic configuration of a printer 1 serving as one embodiment of the present invention. The printer 1 is an inkjet printer, which is one type of liquid discharge apparatus for discharging a liquid. The printer 1 forms ink dots on a print medium by discharging ink, and thereby records characters, graphics, images, and the like corresponding to print data. The printer 1 is provided with a control unit 10 and a print head 20. The control unit 10 executes a computational process for printing an image on the basis of the print data, which is supplied from a host computer. The print head 20 is provided with a plurality of nozzles for discharging one or a plurality of colors of ink supplied from an ink reservoir. The control unit 10 and the print head 20 are electrically connected together via a flat cable 190.

The control unit 10 is provided with a main control section 120, an interface (IF) 140, a digital-to-analog converter (DAC) 160, and a main power source circuit 180. The main control section 120, when the print data is acquired from the host computer, executes a predetermined process and generates nozzle selection data (drive signal selection data) for defining those nozzles of the print head 20 from which the ink should be discharged, or the amount of ink that should be discharged. The main control section 120 outputs a control signal to the IF 140 and the DAC 160 on the basis of the print data, the drive signal selection data, and the like. The control signal supplied to the IF 140 is supplied to a head control section 220 via the IF 210. Digital control data dCOM is supplied to the DAC 160 as a control signal. The DAC 160 converts the control data dCOM to an analog original drive signal COM, which is then outputted to the print head 20. The main power source circuit 180 supplies a power source voltage to each of the parts of the control unit 10. Also, the main power source circuit 180 supplies power source voltages VO, G to the print head 20. G is the ground potential, and herein serves as a reference of voltage zero. The voltage VO serves as a high side, with respect to the ground G.

The print head 20 is provided with drivers 30, nozzle actuator elements 40, an auxiliary power source circuit 50, the IF 210, the head control section 220, and a selection section 230. There are a plurality of the nozzle actuator elements 40, provided so as to correspond to the plurality of nozzles. There are a plurality of the drivers 30, provided so as to correspond to each of the nozzle actuator elements 40. The nozzle actuator elements 40 are drive elements for causing the ink to be discharged from the nozzles, and are constituted of capacitive elements such as piezoelectric elements (piezo elements). The nozzle actuator elements 40 are provided as a plurality so as to correspond to each of the plurality of nozzles with which the print head 20 is provided, and one end thereof is connected to an output terminal of the drivers 30 and the other end is grounded to the ground G. The nozzle actuator elements 40 are provided to a cavity (ink chamber), and when driven with a drive signal aCOM, cause the ink to be discharged by changing the volume of the cavity.

The drivers 30 drive the nozzle actuator elements 40 in conformity with the original drive signal COM acquired via the selection section 230 from the DAC 160. More specifically, the drivers 30 are configured to comprise a non-linear amplifier circuit, and supply the drive signal aCOM, obtained when the original drive signal is subjected to non-linear current amplification, to the nozzle actuator elements 40. The term "non-linear current amplification" herein refers to amplification with which minute fluctuations not present in the waveform of the original drive signal COM are included in the drive signal aCOM. The drivers 30 use the power source voltage supplied from the auxiliary power source circuit 50 to carry out a power source amplification. The configuration of the drivers 30 shall be described in greater detail below.

The selection section 230 has a plurality of analog switches 232 corresponding to each of the plurality of drivers 30. One end of each of the analog switches 232 is connected to an output terminal of the DAC 160, and the other end is connected to an input terminal of the corresponding driver 30. Each of the analog switches 232 switches between on and off, depending on the control signal that is outputted from the head control section 220. That is to say, the selection section 230 supplies the original drive signal, supplied from the DAC 160, to one or more drivers 30 selected from among the plurality of drivers 30, in conformity with the control by the head control section 220. The head control section 220 acquires the control signal from the main control section 120 via the IF 120, and controls the selection section 230 in conformity with the acquired control signal.

The auxiliary power source circuit 50 uses a charge pump circuit to step up the power source voltage VO supplied from the main power source circuit 180, and also divides the stepped-up voltage. Generated as the divided voltages are a voltage that is a factor of ⅙ of the stepped-up voltage, a voltage that is a factor of ⅔ thereof, a voltage that is a factor of ⅓ thereof, a voltage that is a factor of ⅔ thereof, and a voltage that is a factor of ⅚ thereof. The auxiliary power source circuit 50 supplies the stepped-up voltage $V_H$ and the voltages generated by the division to each of the drivers 30.

Figure 2:
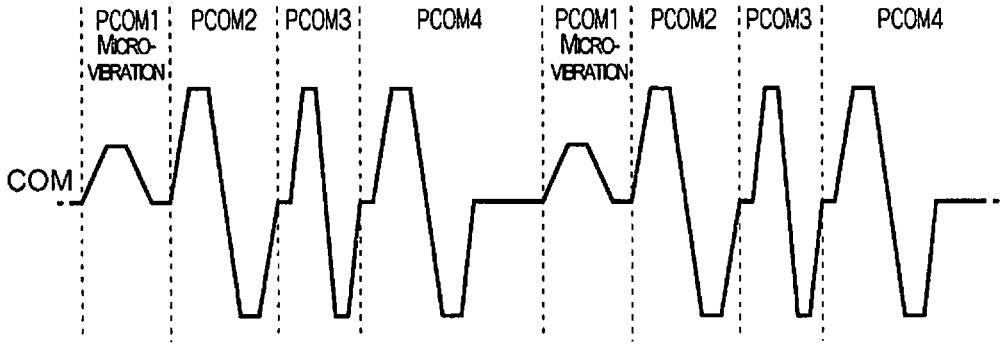
FIG. 2 is a descriptive drawing illustratively exemplifying the waveform of an original drive signal COM supplied to a driver.

FIG. 2 is a descriptive drawing illustratively exemplifying the waveform of an original drive signal COM supplied to the drivers 30. The original drive signal COM has a waveform in which a plurality of non-rectangular shaped original drive pulses PCOM (herein, four original drive pulses PCOM1, PCOM2, PCOM3, and PCOM4) are consecutive in time series. Each of the four original drive pulses PCOM1 to PCOM4 is a unit drive signal serving as the smallest unit of a signal for driving the nozzle actuator elements 40, and a segment that comprises four original drive pulses PCOM corresponds to one pixel (print pixel). The original drive signal COM, however, need not necessarily comprise all of the original drive pulses PCOM, provided that one or more out of the four original drive pulses PCOM1 to PCOM4 is included. The original drive pulse signal COM of the present embodiment comprises an original drive pulse PCOM1 that is called a micro-vibration. The original drive pulse PCOM1 is used in a case where ink is merely being drawn in and not forced out, e.g., a case where thickening of the nozzles is suppressed.

Figure 3:
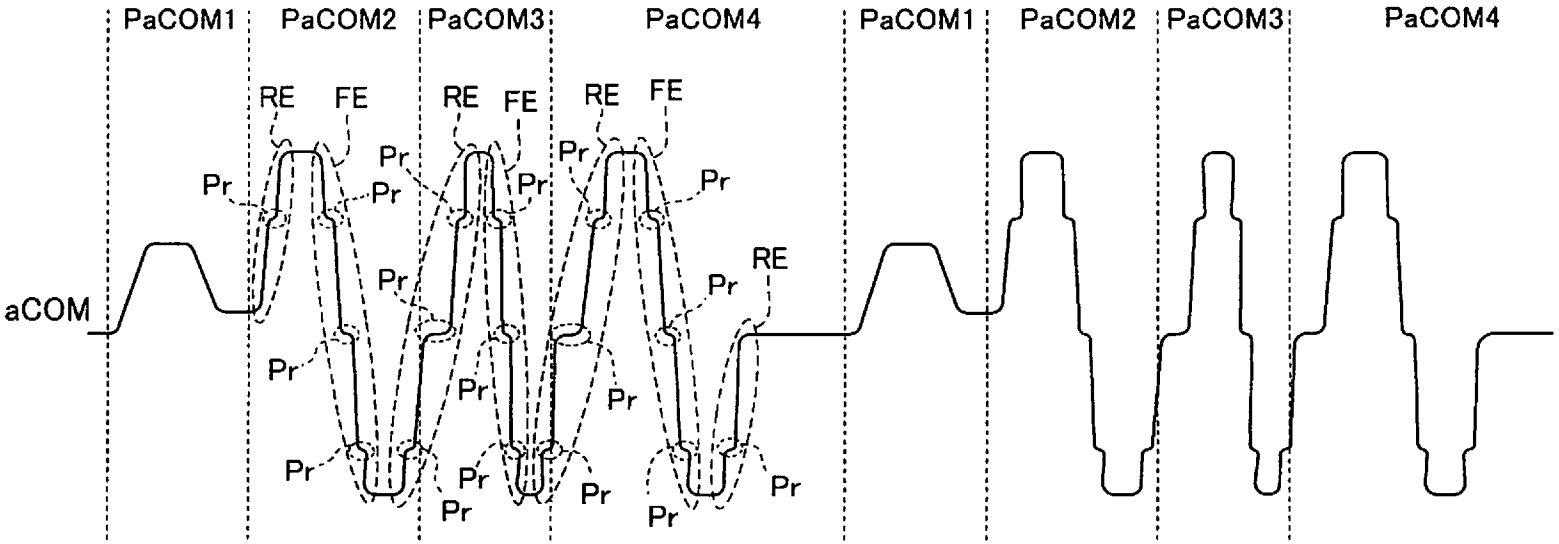
FIG. 3 is a descriptive drawing illustratively exemplifying the waveform of a drive signal aCOM outputted from a driver.

FIG. 3 is a descriptive drawing illustratively exemplifying the waveform of a drive signal aCOM outputted from the drivers 30. The drive signal aCOM has a waveform in which a plurality of non-rectangular shaped drive pulses PaCOM1 to PaCOM4 are consecutive in time series, and the drive pulses PaCOM1 to PaCOM4 correspond respectively to each of the original drive pulses PCOM1 to PCOM4 of FIG. 3. In the waveform of the drive signal aCOM, a plurality of rising portions RE and a plurality of falling portions FE are formed by the drive pulses PaCOM. When the rising portions RE of the drive signal aCOM are supplied to the nozzle actuator elements 40, the nozzle actuator elements 40 cause the volume of the cavities of the nozzles to expand, and ink is drawn in to the cavities from a flow path. When the falling portions FE of the drive signal aCOM are supplied to the nozzle actuator elements 40, the nozzle actuator elements 40 cause the volume of the cavities of the nozzles to contract, and ink is forced out from the cavities.

A plurality of ripples Pr are formed in the waveform of the drive signal aCOM. The "ripples Pr" refer to minute stepped parts that are not present in the waveform of the original drive signal COM but are included in the waveform of the drive signal aCOM. The ripples Pr occur due to the properties of non-linear amplifier circuits (here, the drivers 30). When the falling portions FE of the waveform of the drive signal aCOM include the ripples Pr, a minute fluctuation is created in the operation of contracting the cavity volume (discharge operation) by the nozzle actuator elements 40. For this reason, in one instance of the discharge operation, a plurality of ink droplets are discharged, or discharging is followed by easier division into a plurality of ink droplets. The ink droplets divided into a plurality are light-weight and therefore could potentially become an ink mist, more readily attaching to the variety of mechanical parts constituting the printer 1 and causing failure of the printer 1. Failure of the ink droplets to land on the anticipated landing positions could also possible cause deterioration of the image quality of the printed image.

The present inventors have, however, discovered an advantage provided by having the ripples Pr be included in the waveform of the drive signal aCOM. More specifically, when the ripples Pr cause the discharge operation to include the minute fluctuations, the nozzle actuator elements 40 experience a minute acceleration/deceleration, and therefore it is possible to suppress the inertia that acts on the nozzle actuator elements 40 immediately after the cavity volume has been contracted. That is to say, when a drive signal aCOM, such as per FIG. 2, from which the ripples Pr are absent is supplied to the nozzle actuator elements 40, it is possible that excess from (overshooting by) the nozzle actuator elements 40 could cause a greater amount of ink than anticipated to be discharged. When the drive signal aCOM contains the ripples Pr, however, the inertia that acts on the nozzle actuator elements 40 immediately after the cavity volume has been contracted is suppressed, and therefore an advantage arises in that it is possible to suppress the increase, caused by overshooting, in the amount of ink discharged. Also, when the ripples Pr cause the discharge operation to include the minute fluctuations, even with a minute variance in the amount of deformation of the nozzle actuator elements 40 or in the volume of the cavities in relation to the drive signal aCOM for every printer 1, these variances can be absorbed. That is to say, when the drive signal aCOM includes the ripples Pr, an advantage arises in that a variance in the discharged amount caused by manufacturing errors in the printers 1 can be suppressed.

The present inventors have discovered that, while having the waveform of the drive signal aCOM include the ripples Pr in order to take advantage of the aforementioned advantages imparted by the ripples Pr, increasing the viscosity of the ink is effective as a method for solving a problem where the ink droplets are divided because of the ripples Pr. More specifically, it has been discovered that the ink used for the printer 1 preferably contains 0.1 wt % to 10 wt %, more preferably 1 to 7 wt %, of a polar solvent in order to increase the viscosity. In general, long tailing occurs in the ink droplets when the viscosity of the ink is high, and this tailing divides into a plurality of ink droplets when the ink is in flight; therefore, the image quality is more likely to deteriorate. The term "tailing" herein refers to thread-shaped streaking of the ink that is formed on the rear side in the direction of travel of the discharged ink droplets (main droplets). However, the drivers 30 of the present embodiment carry out non-linear amplification, not the linear amplification seen with class AB amplifier circuits, and therefore the waveform of the drive signal includes the ripples. For this reason, when an ink that is not high in viscosity is used for the printer 1 of the present embodiment, the ink droplets experience separation and the image quality decreases. Accordingly, with the printer 1 of the present embodiment, using an ink that contains 0.1 wt % to 10 wt %, preferably 1 to 7 wt %, of a polar solvent makes it possible to suppress the occurrence of the separation of the ink droplets in flight. Also, using an amplifier circuit that carries out non-linear amplification, as with the drivers 30 of the present embodiment, makes it possible to minimize the power consumed by the printer.

Though not particularly limited, possible illustrative examples of the polar solvent included in the ink are 1,2-hexanediol, triethylene glycol, monobutyl ether, glycerol, propylene glycol, 2-pyrrolidone, N-methyl pyrrolidone, pyrrole, furan, thiophene, imidazole, oxazole, thiazole, pyrazole, isoxazole, isothiazole, pyridine, pyridazine, pyrimidine, pyrazine, piperidine, piperazine, morpholine, 2H-pyran, 4H-pyran, ϵ-caprolactam, dimethyl sulfoxide, sulfolane, morpholine, N-ethyl morpholine, 1,3-dimethyl-2-imidazolidinone, N-acryloyl morpholine, and N,N-vinyl-2-pyrrolidone. Of these, 1,2-hexanediol is preferably contained, in order to improve the discharge stability.

Another example of a preferable component composition of the ink shall be illustrated. Preferably, the ink contains at least a colorant, a photopolymerizable resin, a photopolymerization initiator, and a polar solvent. Preferably, the photopolymerizable resin included in the ink is constituted of oligomer particles in an emulsion state and a monomer present among the oligomer particles. Any one or more species from among 2-pyrrolidone, N-acryloyl morpholine, and N-vinyl-2-pyrrolidone is preferably contained as the polar solvent included in the ink; more preferably, 2-pyrrolidone or N-acryloyl morpholine is contained. Because the photopolymerizable resin is constituted of the oligomer particles in an emulsion state and the monomer present among the oligomer particles, the photopolymerizable resin is uniformly dispersed in the ink and stored in this state for a long time. Also, the polar solvent composed of the any one or more species among 2-pyrrolidone, N-acryloyl morpholine, and N-vinyl-2-pyrrolidone is contained at a proportion of 0.1 wt % to 10 wt %, the print stability can be successfully improved. The ink film strength obtained after light irradiation can also be raised in a case where 2-pyrrolidone or 2-acryloyl morpholine is contained as the polar solvent.

FIG. 4 is a descriptive drawing illustratively exemplifying the components of the ink used in the printer 1 of the present embodiment. The ink illustrated as the sample S1 contains 1,2-hexanediol, 2-pyrrolidone, triethylene glycol, monobutyl ether, and propylene glycol as polar solvents. The inks illustrated as samples S2 and S3 contain glycerol, in addition to the components contained in the sample S1, as polar solvents. The inks illustrated as the samples S1 to S3 contain 0.1 wt % to 10 wt % in polar solvents. When these samples S1 to S3 are used for the printer 1, the occurrence of separation of ink droplets can be better suppressed.

Preferably, the viscosity of the ink is set in accordance with the magnitude of the ripples Pr included in the waveform of the drive signal aCOM. That is to say, larger ripples Pr means that the ink droplets discharged in one instance of the discharge operation are more readily separated into a plurality, and therefore further increasing the viscosity of the ink makes it possible to suppress the separation of the ink droplets. In a case where the ripples Pr are small in relation to the viscosity of the ink, however, the tailing of the discharged ink droplets causes the ink droplets to more readily separate into a plurality, and therefore lowering the viscosity of the ink makes it possible to suppress separation of the ink droplets. Preferably, the magnitude of the ripples Pr is set according to the viscosity of the ink, provided that it is possible to adjust the magnitude of the ripples Pr included in the waveform of the drive signal aCOM in the drivers 30.

According to the printer 1 described above, the drivers 30 include a non-linear amplifier circuit, and therefore it is possible to minimize the power consumed more so than with a printer that comprises a linear amplifier circuit. In turn, according to the printer 1, because the ink contains 0.1 wt % to 10 wt % in polar solvent, it is possible to suppress the occurrence of separation of the ink droplets during discharge even though the waveform of the drive signal includes the ripples. The occurrence of separation of the ink droplets caused by tailing can also be suppressed. Moreover, according to the printer 1, because the waveform of the drive signal includes the ripples, it is possible to suppress an increase, caused by overshooting of the nozzle actuator elements 40 immediately after discharge, in the amount of ink discharged. It is also possible to suppress a variance in the discharged amount caused by manufacturing errors.

B. First Example of Driver 30

Figure 5:
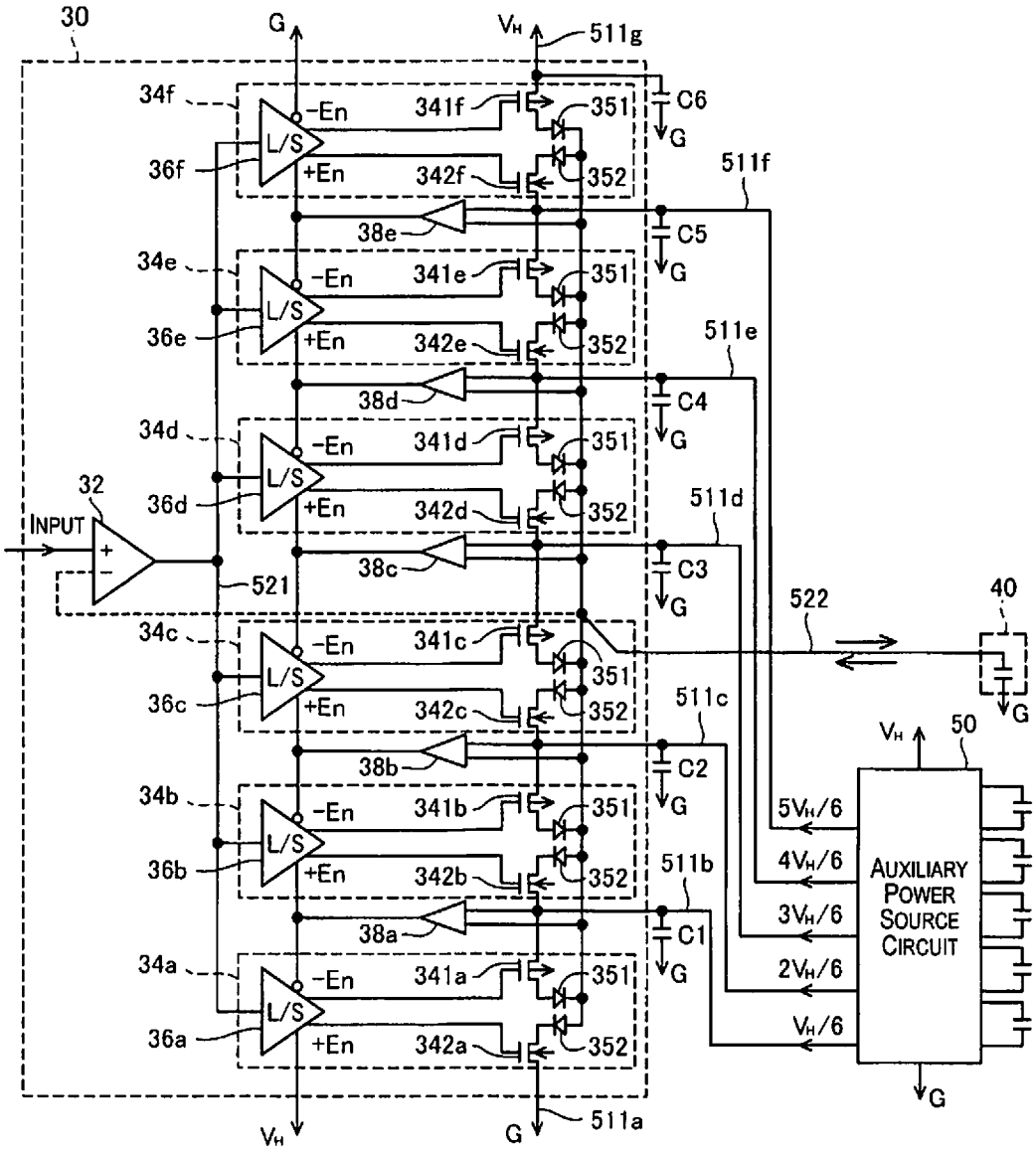
FIG. 5 is a descriptive drawing illustratively exemplifying a schematic configuration of a driver serving as a first embodiment.

FIG. 5 is a descriptive drawing illustratively exemplifying a schematic configuration of a driver serving as a first example. The driver 30 is configured so that the voltage (output voltage) Vout of the drive signal aCOM outputted to the nozzle actuator element 40 changes in accordance with the voltage (input voltage) Vin of the inputted original drive signal COM. The output voltage Vout is proportional to the amount of charge held (stored) in the nozzle actuator element 40. Accordingly, the driver 30 causes the amount of displacement of the nozzle actuator element 40 to change in accordance with the input voltage Vin. The driver 30 is provided with an operational amplifier 32, a plurality of unit amplifier circuits 34, and a plurality of comparators 38. The driver 30 of the present embodiment is provided with six unit amplifier circuits 34 (a first unit amplifier circuit 34*a*, a second unit amplifier circuit 34*b*, a third unit amplifier circuit 34*c*, a fourth unit amplifier circuit 34*d*, a fifth unit amplifier circuit 34*e*, and a sixth unit amplifier circuit 340 and five comparators 38 (a first comparator 38*a*, a second comparator 38*b*, a third comparator 38*c*, a fourth comparator 38*d*, and a fifth comparator 38*e*).

Supplied to the driver 30 are seven types of voltage (ground G, $V_H/6$, $2V_H/6$, $3V_H/6$, $4V_H/6$, $5V_H/6$, $V_H$), including voltage zero, via power source wirings 511*a* to 511*g*. Out of these, five types of voltage, excluding voltage zero and the voltage $V_H$, are supplied from the auxiliary power source circuit 50 via the power source wirings 511*b* to 511*f*, respectively. The description that follows understands the six unit amplifier circuits 34*a* to 34*f* to have respective one-to-one correspondences with segments (six segments) between two adjacent voltages of the seven types of voltage. More specifically, the correspondences are as follows.

First unit amplifier circuit 34*a*: zero to $V_H/6$

Second unit amplifier circuit 34*b*: $V_H/6$ to $2V_H/6$

Third unit amplifier circuit 34*c*: $2V_H/6$ to $3V_H/6$

Fourth unit amplifier circuit 34*d*: $3V_H/6$ to $4V_H/6$

Fifth unit amplifier circuit 34*e*: $4V_H/6$ to $5V_H/6$

Sixth unit amplifier circuit 34*f*: $5V_H/6$ to $V_H$

The driver 30 is configured so that out of the six unit amplifier circuits 34*a* to 34*f*, only the unit amplifier circuit 34 for which the output voltage Vout is included in the above segments functions. In each of the unit amplifier circuits 34*a* to 34*f*, segments of corresponding voltages are called "corresponding segments", while lower limit values of corresponding segments are called "low-side voltages" and upper limit values of corresponding segments are called "high-side voltages".

The operational amplifier 32 has an input terminal connected to the selection section 230 and an output terminal connected to each of the unit amplifier circuits 34*a* to 34*f* via an input wiring 521. The operational amplifier 32 amplifies the input voltage Vin supplied from the input terminal in accordance with a previously set voltage amplification factor, and supplies the amplified input voltage Vin to each of the unit amplifier circuits 34*a* to 34*f*. Herein, the description understands the voltage amplification factor of the operational amplifier 32 to be "1", and understands the input voltage Vin to be supplied without alteration to each of the unit amplifier circuits 34*a* to 34*f*. The unit amplifier circuits 34 are current amplifier circuits for supplying a current to the nozzle actuator element 40, using the auxiliary power source circuit 50 as a source of supply of the current, and are configured so as to comprise a level shifter 36, two transistors (a high-side transistor 341 and a low-side transistor 342), and two diodes 351, 352.

The high-side transistor 341 is a P-channel type metal-oxide semiconductor field effect transistor (MOSFET), and the low-side transistor 342 is an N-channel type MOSFET. A drain terminal of each of the two transistors 341, 342 is connected to the nozzle actuator element 40 via an output wiring 522. A gate terminal of each of the two transistors 341, 342 is connected to an output terminal of the level shifter 36. A source terminal of the high-side transistor 341 is connected to that power source wiring 511 by which the high-side voltage of the unit amplifier circuit 34, in which the high-side transistor 341 is included, is supplied, out of the power source wirings 511*a* to 511*e*. A source terminal of the low-side transistor 342 is connected to that power source wiring 511 by which the low-side voltage of the unit amplifier circuit 34, in which the low-side transistor 342 is included, is supplied, out of the power source wirings 511*a* to 511*e*. For example, the source terminal of the high-side transistor 341 of the fourth unit amplifier circuit 34*d* (low-side voltage: $3V_H/6$, high-side voltage: $4V_H/6$) is connected to the power source wiring 511*e*, by which $4V_H/6$ is supplied. The source terminal of the low-side transistor 342 of the fourth unit amplifier circuit 34*d* is connected to the power source wiring 511*d*, by which $3V_H/6$ is supplied. In the description that follows, a high-side transistor included in an N-th unit amplifier circuit 34M is also called the "N-th high-side transistor $\mathbf{341}_M$", and a low-side transistor 342 included in the N-th unit amplifier circuit $\mathbf{34}_M$ is also called the "N-th low-side transistor $\mathbf{342}_M$" (where N=1 to 6 and M=a to f).

The level shifter 36 takes either an enable state or a disable state, and when in the enable state, supplies a voltage obtained by shifting the inputted input voltage Vin to the two transistors 341, 342. The level shifter 36 takes the enable state when the signal supplied to a negative control end, labeled with a circle in FIG. 5, is at an L level and the signal supplied to a positive control end is at an H level, and takes the disable state at all other times. The level shifter 36 in the enable state shifts the inputted input voltage Vin by a predetermined value $\alpha$ in a plus direction (Vin+$\alpha$) and supplies same to the gate terminal of the high-side transistor 341, and shifts the input voltage Vin by the predetermined value $\alpha$ in a minus direction (Vin−$\alpha$) and supplies same to the gate terminal of the low-side transistor 342. The level shifter 36 in the disable state, however, supplies the voltage $V_H$ to the gate terminal of the high-side transistor 341 and supplies zero voltage to the gate terminal of the low-side transistor 342, irrespective of the inputted input voltage Vin. For the predetermined value $\alpha$, it would be possible to employ a voltage (for example, 0.6 V) between source and gate at which a current begins to flow to the drain terminal. In the description that follows, a level shifter included in the N-th unit amplifier circuit $\mathbf{34}_M$ is also called an "N-th level shifter $\mathbf{36}_M$ (where N=1 to 6 and M=a to f).

The diode 351 has an anode connected to the drain terminal of the high-side transistor 341 and a cathode connected to the nozzle actuator element 40; the current is prevented from flowing from the nozzle actuator element 40 to the drain terminal of the high-side transistor 341. The diode 352 has an anode connected to the nozzle actuator element 40 and a cathode connected to the drain terminal of the low-side transistor 342; the current is prevented from flowing from the drain terminal of the low-side transistor 342 to the nozzle actuator element 40.

The comparators 38*a* to 38*e* are provided with two input terminals and one output terminal; one of the input terminals is connected to the output wiring 522 and the other of the input terminals is connected to one of the power source wirings 511*b* to 511*f* extending from the auxiliary power source circuit 50. The power source wirings to which the other of the input terminals of the comparators 38*a* to 38*e* is connected and the voltages supplied from the power source wirings are as follows.

First comparator 38*a*: Power source wiring 511*b*: $V_H/6$

Second comparator 38*b*: Power source wiring 511*c*: $2V_H/6$

Third comparator 38*c*: Power source wiring 511*d*: $3V_H/6$

Fourth comparator 38*d*: Power source wiring 511*e*: $4V_H/6$

Fifth comparator 38*e*: Power source wiring 511*f*: $5V_H/6$

In each of the comparators 38*a* to 38*e*, the voltage supplied from the auxiliary power source circuit 50 via the power source wiring 511 is also called the "corresponding power source voltage". The comparators 38 compare the voltage (output voltage Vout) of the output wiring 522 and the voltage (corresponding power source voltage) supplied from the auxiliary power source circuit 50, and output the H level when the output voltage Vout is not less than the corresponding power source voltage but output the L level when the output voltage Vout is less than the corresponding power source voltage. The output terminal of each of the comparators 38*a* to 38*e* is connected to the positive control end of the level shifter 36 of the unit amplifier circuit 34 for which its own corresponding power source voltage is the low-side voltage, and to the negative control end of the level shifter 36 of the unit amplifier circuit for which its own corresponding power source voltage is the high-side voltage. For example, the output terminal of the fourth comparator 38*d* (corresponding power source voltage: $4V_H/6$) is connected to the positive control end of the fifth level shifter 36*e* of the fifth unit amplifier circuit 34*e* (low-side voltage: $4V_H/6$) and the negative control end of the fourth level shifter 36*d* of the fourth unit amplifier circuit 34*d* (high-side voltage: $4V_H/6$).

Connected to the power source wirings 511*b* to 511*g* is one end part of mutually different capacitors C (capacitors C1 to C6). The power source wirings 511*b* to 511*g* are connected to the ground G via the capacitors C1 to C6.

FIG. 6 is a descriptive drawing for describing the relationship between the output voltage Vout and the operations of the comparators and level shifters. FIG. 6 illustrates the range of the output voltage Vout, the levels of the output signals of each of the comparators 38*a* to 38*e* (H: H level; L: L level), and the states of each of the level shifters 36*a* to 36*f* (E: enable state; D: disable state). As will be understood from FIG. 6, the driver 30 is configured so that only one level shifter out of the six level shifters 36*a* to 36*f* takes the enable state, depending on the output voltage Vout.

Figure 7A:
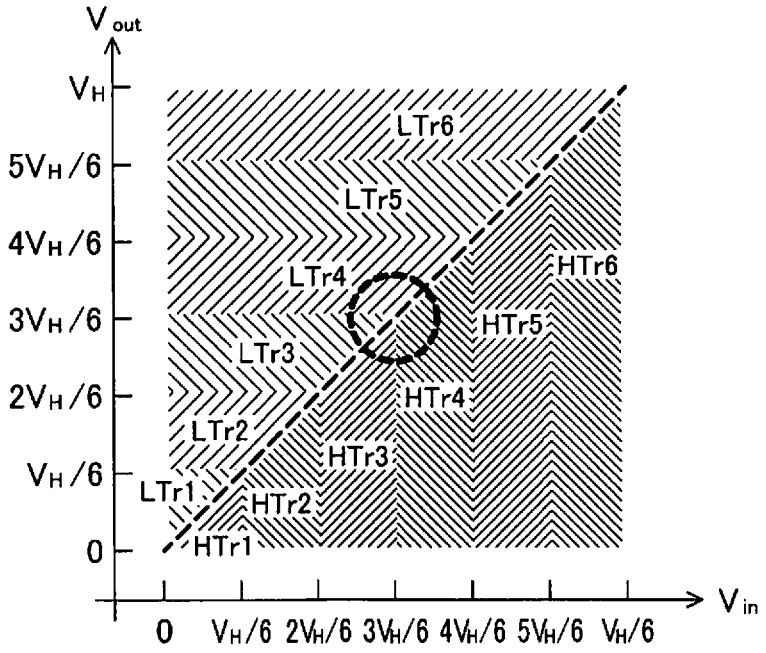
FIGS. 7A and 7B are descriptive drawings for describing the relationships between an input voltage Vin and output voltage Vout, and the operating states of a high-side transistor and a low-side transistor.
Figure 7B:
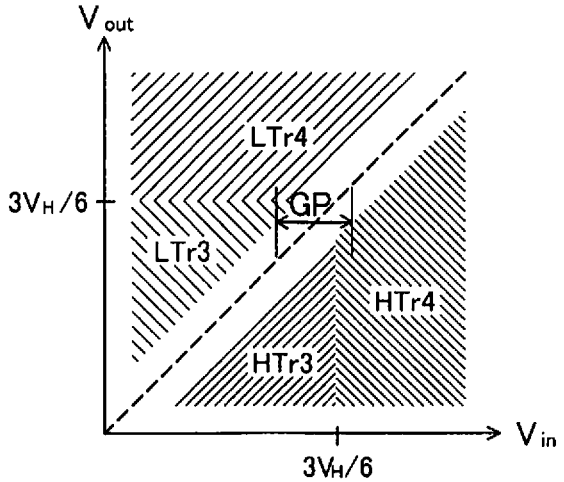

FIG. 7 is a descriptive drawing for describing the relationships between the input voltage Vin and output voltage Vout, and the operating states of the high-side transistor and the low-side transistor. The horizontal axis of FIG. 7 indicates the input voltage Vin, and the vertical axis indicates the output voltage Vout. The plurality of hatchings illustrated in FIGS. 7A and 7B indicate the regions (operating regions) where each of the transistors (the high-side transistors 341*a* to 341*f* and low-side transistors 342*a* to 342*f*) operate. The "HTrN (N=1 to 6) in FIG. 7 indicates the N-th high-side transistor 341, and "LTrN (N=1 to 6)" indicates the N-th low-side transistor 342. As will be understood from FIG. 7A, in the driver 30, the high-side transistors 341*a* to 341*f* operate when a state where the input voltage Vin is higher than the output voltage Vout is in effect, and the low-side transistors 342*a* to 342*f* operate when a state where the input voltage Vin is lower than the output voltage Vout is in effect.

FIG. 7B is a drawing enlarging the vicinity of the portion illustrated with a dashed-line circle in FIG. 7A. As illustrated in FIG. 7B, a voltage gap GP is set between the operating regions of the high-side transistors 341 and the operating regions of the low-side transistors 342. The voltage gap GP refers to a difference between the input voltages Vin of the operating regions of the high-side transistors 341 and the operating regions of the low-side transistors 342 at the same output voltage Vout. The voltage gap GP is proportional to the amount of shifting of the level shifters 36, and is $GP=2\alpha$. This voltage gap GP makes it possible to prevent a through current from flowing from the high-side transistors 341 to the low-side transistors 342 in one unit amplifier circuit 34.

Figure 8A:
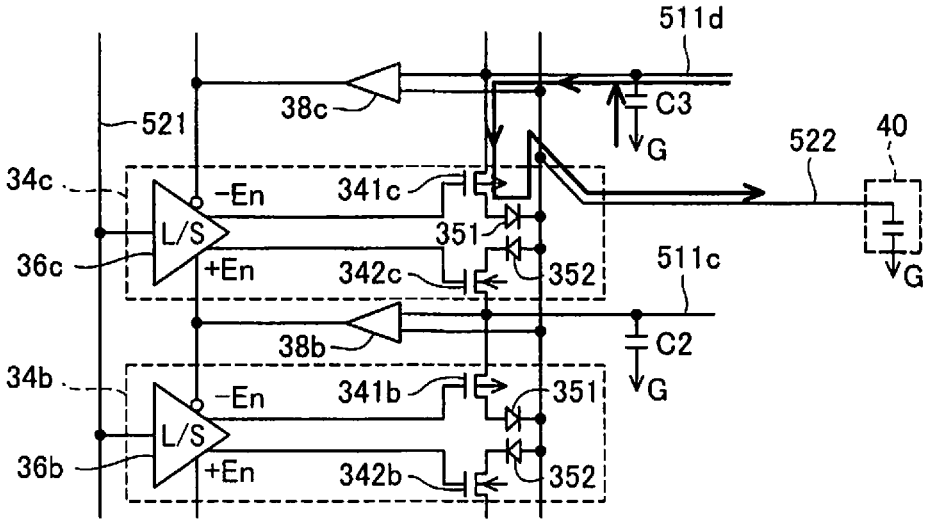
FIGS. 8A and 8B are descriptive drawings for describing the flow of current in a driver during charging and discharging of a nozzle actuator element.

FIG. 8 is a descriptive drawing for describing the flow of current in the driver during charging and discharging of the nozzle actuator element. FIG. 8A is a descriptive drawing for describing the flow of the current during charging. The flow of the current for when the output voltage Vout is in the range of $2V_H/6$ to $3V_H/6$ and the input voltage Vin is greater than the output voltage Vout shall be described herein, as one example. Because the output voltage Vout is $2V_H/6$ to $3V_H/6$, only the third level shifter 36*c* out of the six level shifters 36*a* to 36*f* of the driver 30 is in the enable state. For this reason, only the third unit amplifier circuit 34*c* out of the six unit amplifier circuits 34*a* to 34*f* functions. Also, because the input voltage Vin is greater than the output voltage Vout, only the third high-side transistor 341*c* out of the two transistors 341*c*, 342*c* included in the third unit amplifier circuit 34*c* functions, and a current corresponding to the voltage between source and gate flows. This causes the nozzle actuator element 40 to be charged with the current supplied from the auxiliary power source circuit 50 or the capacitor C3, via the power source wiring 511*d*, the third high-side transistor 341*c*, and the output wiring 522, as illustrated by the arrows in FIG. 8A.

Figure 8B:
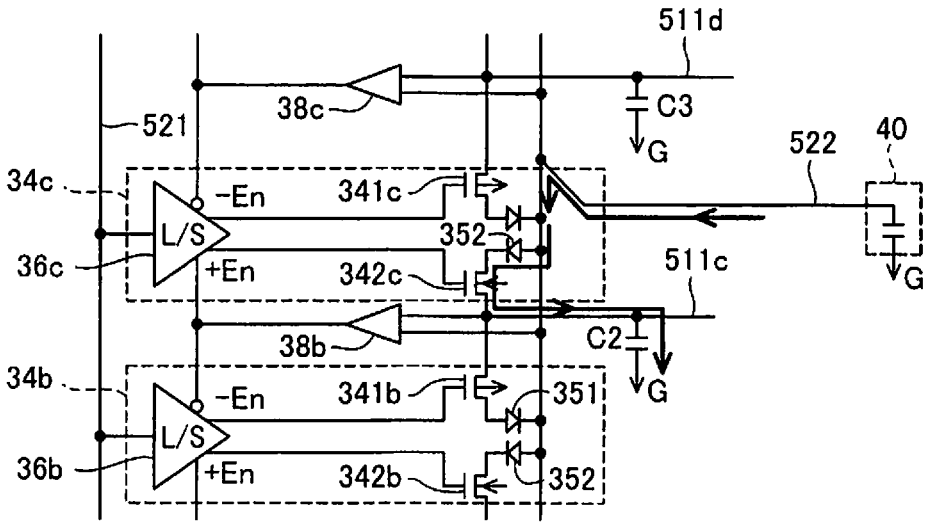

FIG. 8B is a descriptive drawing for describing the flow of the current during discharging. The flow of the current for when the output voltage Vout is in the range of $2V_H/6$ to $3V_H/6$ and the input voltage Vin is less than the output voltage Vout shall be described herein, as one example. At this time, only the third low-side transistor 342*c* out of the two transistors 341*c*, 342*c* included in the third unit amplifier circuit 34*c* functions, and a current corresponding to the voltage between source and gate flows. This causes the capacitor C2 to be charged with a current discharged from the nozzle actuator element 40, via the output wiring 522, the third low-side transistor 342*c*, and the power source wiring 511*c*, as illustrated with the arrows in FIG. 8B. The energy with which the capacitor C2 is charged is utilized for when the nozzle actuator element 40 is being charged via the second unit amplifier circuit 34*b*. For this reason, it is possible to reduce the loss of energy that occurs during charging and discharging of the nozzle actuator element 40.

Figure 9:
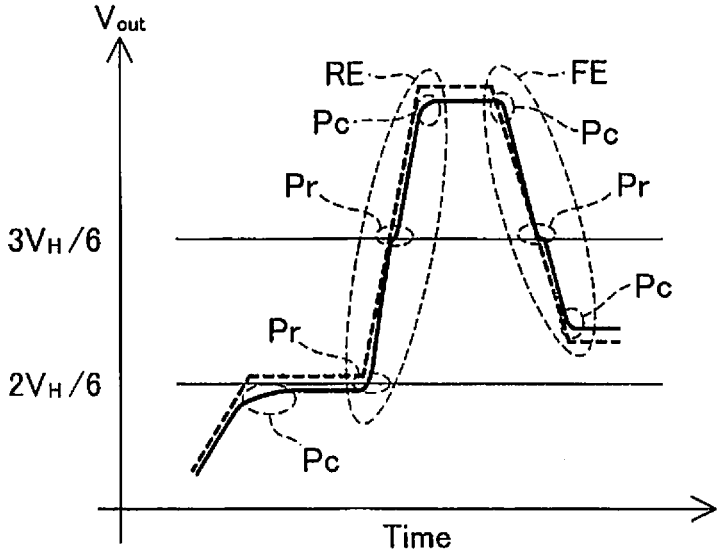
FIG. 9 is a descriptive drawing for describing in greater detail the waveform of the drive signal aCOM outputted from the driver.

FIG. 9 is a descriptive drawing for describing in greater detail the waveform of the drive signal aCOM outputted from the driver. FIG. 9 depicts the waveform of the drive signal aCOM with a solid line and depicts the waveform of the original drive signal COM with a dashed line. The plurality of ripples Pr are formed in the waveform of the drive signal aCOM that is outputted from the driver 30 of the present embodiment. At least part of the ripples Pr is formed when the output voltage Vout is near $V_H/6$, $2V_H/6$, $3V_H/6$, $4V_H/6$, and $5V_H/6$. That is to say, the ripples Pr are formed when the rise or fall of the output voltage Vout causes the operating unit amplifier circuit 34 to be switched to another unit amplifier circuit 34. For example, in FIG. 9, when $3V_H/6$ is reached because of rising of the output voltage Vout, the operating unit amplifier circuit 34 is switched from the third unit amplifier circuit 34*c* to the fourth unit amplifier circuit 34*d*. The speed of rising of the output voltage Vout in the third unit amplifier circuit 34*c* decreases when the output voltage Vout approaches $3V_H/6$. This causes the slope of the rising portion RE of the waveform of the drive signal aCOM to be reduced near $3V_H/6$. Thereafter, with the switching to the fourth unit amplifier circuit 34*d*, the speed of rising of the output voltage Vout is restored and the slope of the rising portion RE is also restored, and therefore a minute stepped part, i.e., a ripple Pr is formed in the waveform near $3V_H/6$. A ripple Pr is formed near $3V_H/6$ for a similar reason also for the falling portion FE of the waveform of the drive signal aCOM. The waveform of the drive signal aCOM does also curve more than the original drive signal COM, thus forming a curved part Pc, at near the boundary between the rising portion RE and the flat part, and at near the boundary between the flat part and the falling portion FE. These curved parts Pc are due to the fact that the input voltage Vin and the output voltage Vout are located near the voltage gap GP (FIG. 7) between the operating region of the high-side transistor 341 and the operating region of the low-side transistor 342. Because a minute fluctuation occurs in the waveform also at these curved parts Pc, the curved parts Pc can also be regarded as one aspect of the ripples Pr.

According to the driver 30 of the first example, described above, the operating unit amplifier circuit 34 is switched in accordance with the output voltage Vout during generation of the drive signal aCOM, and therefore it is possible to form the ripples Pr in the waveform of the drive signal aCOM. Also, because the operating unit amplifier circuit 34 is switched in accordance with the output voltage Vout according to the driver 30, it is possible to reduce the loss of energy that occurs during charging and discharging of the nozzle actuator element 40. The reason for this shall be described below.

Formula (1) represents the energy P that is lost during charging and discharging of the nozzle actuator element 40.

$$P=(C\cdot E^2)/2 \quad (1)$$

In the formula (1), C is the capacitance of the nozzle actuator element 40, and E is the voltage amplitude of the voltage that is supplied to the nozzle actuator element 40. In a case where, for example, there are not a plurality of unit amplifier circuits used, as with the driver 30, but rather the output voltage Vout is brought from 0 to VH using solely one amplifier circuit, then the energy lost will be $P=(C\cdot V_H^2)/2$ ($E=V_H-0$). In the driver 30, however, the six unit amplifier circuits 34 function in sequence in a case where the output voltage Vout is brought from 0 to $V_H$. For this reason, the energy Pi lost in each of the unit amplifier circuits 34 is $Pi=(C\cdot(V_H/6)^2)/2(E=\frac{1}{6}V_H-0)$. Accordingly, the sum P of the energy lost is $P=6(C\cdot(V_H/6)^2)/2=(C\cdot V_H^2)/12$. Therefore, it will be understood that the driver 30, when compared to having a single amplifier circuit, makes it possible to reduce the energy lost P to ⅙.

C. Second Example of Driver 30

Figure 10:
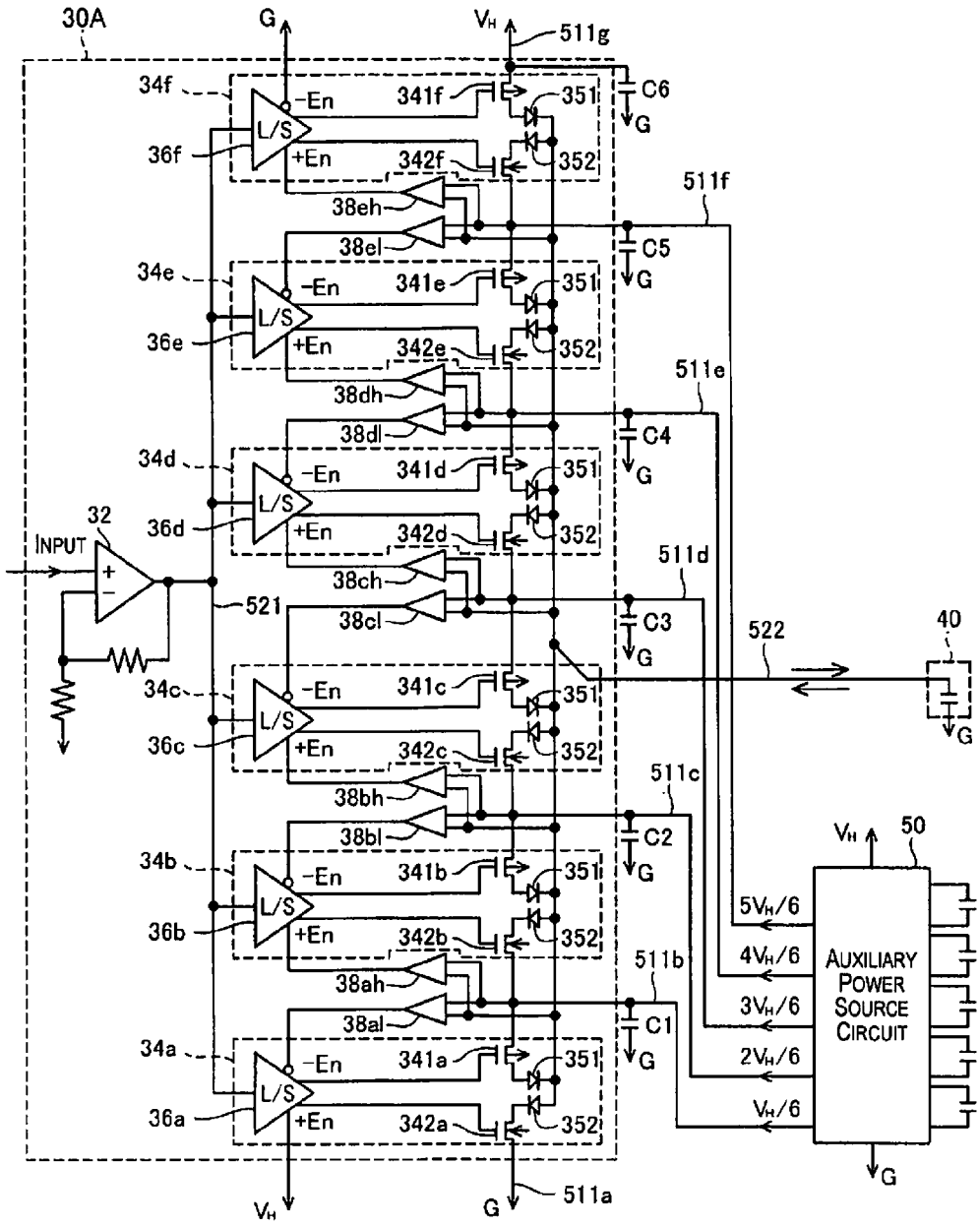
FIG. 10 is a descriptive drawing illustratively exemplifying a schematic configuration of a driver serving as a second example.

FIG. 10 is a descriptive drawing illustratively exemplifying a schematic configuration of a driver 30A serving as a second example. Compared to the driver 30 of the first example, the driver 30A of the second example is different in terms of the configuration of the comparator 38. The driver 30A of the second example is provided with ten comparators 38 (a first high-side comparator 38*ah*, a first low-side comparator 38*al*, a second high-side comparator 38*bh*, a second low-side comparator 38*bl* a third high-side comparator 38*ch*, a third low-side comparator 38*cl* a fourth high-side comparator 38*dh*, a fourth low-side comparator 38*dl* a fifth high-side comparator 38*eh*, and a fifth low-side comparator 38*el*). A pair of N-th comparators $\mathbf{38}_M h$, $\mathbf{38}_M l$ (an N-th high-side comparator $\mathbf{38}_M h$ and an N-th low-side comparator $\mathbf{38}_M l$) of the second example corresponds to the N-th comparator $\mathbf{38}_M$ of the first example (where N=1 to 5 and M=a to e).

One of the input terminals of each of the comparators 38*ah* to 38*ef*, 38*al* to 38*el* is connected to the output wiring 522, and the other input terminal is connected to the following power source wirings.

Pair of first comparators 38*ah*, 38*al*: Power source wiring 511*b*

Pair of second comparators 38*bh*, 38*bl*: Power source wiring 511*c*

Pair of third comparators 38*bh*, 38*bl*: Power source wiring 511*d*

Pair of fourth comparators 38*dh*, 38*dl*: Power source wiring 511*e*

Pair of fifth comparators 38*eh*, 38*el*: Power source wiring 511*f*

The output terminals of the high-side comparators 38*ah* to 38*eh* are connected to the positive control ends of the level shifters 36 of the unit amplifier circuits 34 for which the respective corresponding power source voltage thereof is the low-side voltage. For example, the output terminal of the fourth high-side comparator 38*dh* (corresponding power source voltage: $4V_H/6$) is connected to the positive control end of the fifth level shifter 36*e* of the fifth unit amplifier circuit 34*e* (low-side voltage: $4V_H/6$). In turn, the output terminals of the low-side comparators 38*al* to 38*el* are connected to the negative control ends of the level shifters 36 of the unit amplifier circuits 34 for which the respective corresponding power source voltage thereof is the high-side voltage. For example, the output terminal of the fourth low-side comparator 38*dl* (corresponding power source voltage: $4V_H/6$) is connected to the negative control end of the fourth level shifter 36*d* of the fourth unit amplifier circuit 34*e* (high-side voltage: $4V_H/6$).

The high-side comparators 38*ah* to 38*eh* compare the voltage (output voltage Vout) of the output wiring 522) and a voltage Vcm obtained when the voltage Vc (corresponding power source voltage Vc) supplied from the auxiliary power source circuit 50 is shifted by a predetermined value β in the minus direction (corrected voltage Vcm (Vcm=Vc−β), and output the H level when the output voltage Vout is not less than the corrected voltage Vcm but output the L level when the output voltage Vout is less than the corrected voltage Vcm. The predetermined value β can be set as desired within the range $0<\beta<V_H/6$. For example, the fourth high-side comparator 38*dh* outputs the H level when the output voltage Vout is not less than the corrected voltage Vcm ($Vcm=4V_H/6-\beta$), but outputs the L level when the output voltage Vout is less than the corrected voltage Vcm. In turn, the low-side comparators 38*al* to 38*el* compare the output voltage Vout and a corrected voltage Vcm obtained when the corresponding power source voltage Vc is shifted by the predetermined value β in the plus direction (Vcm=Vc+β), and output the H level when the output voltage Vout is not less than the corrected voltage but output the L level when the output voltage Vout is less than the corrected voltage.

For the six level shifters 36*a* to 36*f*, the above-described configuration causes two mutually adjacent level shifters to be in the enable state at the same time when the output voltage is $V_H/6\pm\beta$, $2V_H/6\pm\beta$, $3V_H/6\pm\beta$, $4V_H/6\pm\beta$, $5V_H/6\pm\beta$. For this reason, the six unit amplifier circuits 34*a* to 34*f* are configured so that the corresponding segments of the voltages of two mutually adjacent unit amplifier circuits are partially overlapped. More specifically, the corresponding segments of the voltages of each of the unit amplifier circuits 34*a* to 34*f* are as follows.

First unit amplifier circuit 34*a*: zero to $V_H/6+\beta$

Second unit amplifier circuit 34*b*: $V_H/6-\beta$ to $2V_H/6+\beta$

Third unit amplifier circuit 34*c*: $2V_H/6-\beta$ to $3V_H/6+\beta$

Fourth unit amplifier circuit 34*d*: $3V_H/6-\beta$ to $4V_H/6+\beta$

Fifth unit amplifier circuit 34*e*: $4V_H/6-\beta$ to $5V_H/6+\beta$

Sixth unit amplifier circuit 34*f*: $5V_H/6-\beta$ to $V_H$

For example, when the output voltage Vout is $3V_H/6$, then two unit amplifier circuits, the third unit amplifier circuit 34*c* and the fourth unit amplifier circuit 34*d*, function at the same time.

Figure 11A:
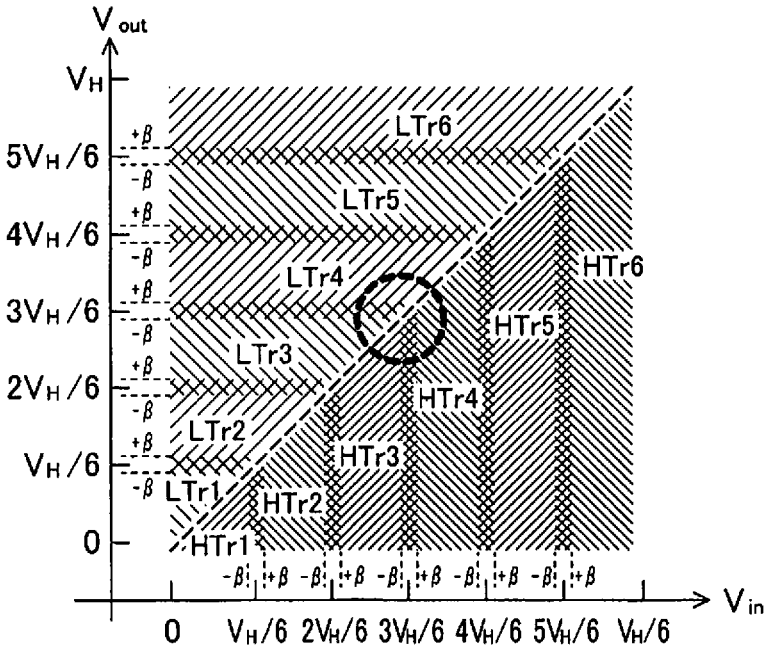
FIGS. 11A and 11B are descriptive drawings for describing the operating state of a transistor in a driver in the second example.
Figure 11B:
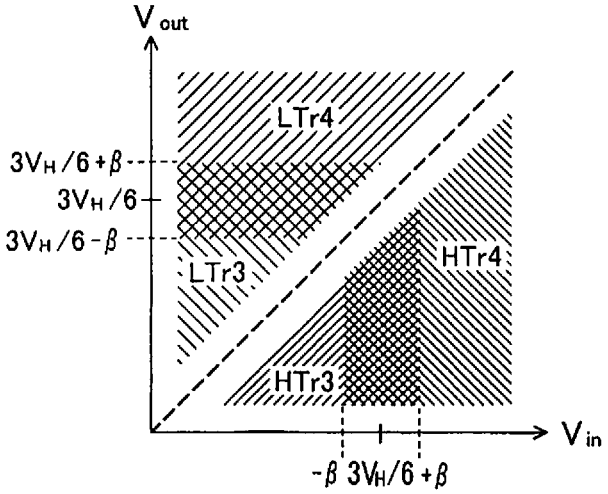

FIG. 11 is a descriptive drawing for describing the operating state of a transistor in the driver in the second example. FIG. 11 corresponds to FIG. 7 of the first example. The plurality of hatchings illustrated in FIGS. 11A and 11B are indicative of the operating regions of each of the transistors 341*a* to 341*f*, 342*a* to 342*f*. The driver 30A of the second example has partial overlap between the operating regions of the high-side transistors 341 included in two mutually adjacent unit amplifier circuits 34, and between the operating regions of the low-side transistors 342 included in two mutually adjacent unit amplifier circuits 34. In FIG. 11, the portions where the operating regions overlap have overlaid hatching and are thus represented with cross-hatching.

FIG. 11*b* is a drawing enlarging the periphery of the portion indicated with a dashed-line circle in FIG. 11A. As illustrated in FIG. 11B, in the driver 30, for example, when the input voltage Vin is higher than the output voltage Vout and is in the range $3V_H/6\pm\beta$, then the third high-side transistor 341*c* and the fourth high-side transistor 341*d* operate at the same time. When the output voltage Vout is higher than the input voltage Vin and is in the range $3V_H/6\pm\beta$, then the third low-side transistor 342*c* and the fourth low-side transistor 342*d* operate at the same time.

Figure 12A:
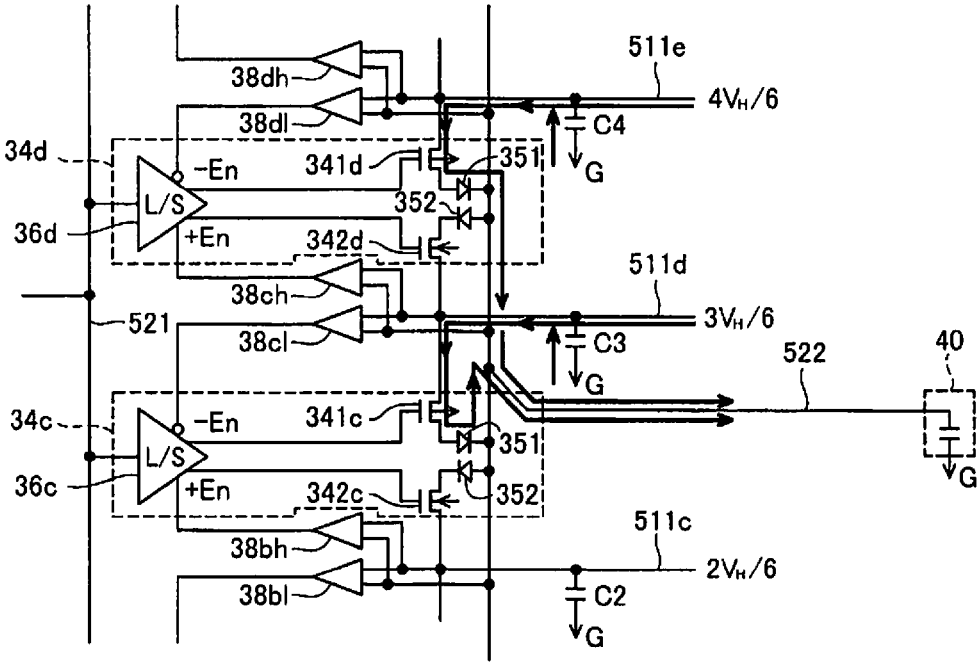
FIGS. 12A and 12B are descriptive drawings for describing the flow of current in a driver during charging and discharging of a nozzle actuator element in a driver of the second example.

FIG. 12 is a descriptive drawing for describing the flow of the current during charging and discharging of the nozzle actuator element in the driver of the second example. FIG. 12A is a descriptive drawing for describing the flow of the current during charging. The flow of the current for when the output voltage Vout is $3V_H/6$ and the input voltage Vin is greater than the output voltage Vout shall now be described herein as one example. In the driver 30, out of the six level shifters 36*a* to 36*f*, the third level shifter 36*c* and the fourth level shifter 36*d* are in the enable state. Accordingly, out of the six unit amplifier circuits 34*a* to 34*f*, the third unit amplifier circuit 34*c* and the fourth unit amplifier circuit 34*d* function. Also, because the input voltage Vin is greater than the output voltage Vout, the respective high-side transistors (third high-side transistor 341*c* and fourth high-side transistor 341*d*) of the third unit amplifier circuit 34*c* and the fourth unit amplifier circuit 34*d* function, and each has flowing therethrough a current corresponding to the voltage between source and gate. Accordingly, as illustrated with the arrows in FIG. 12A, a current is supplied to the nozzle actuator element 40 via the power source wiring 511*e* and the fourth high-side transistor 341*d* from the auxiliary power source circuit 50 and the capacitor C4, and also a current is supplied thereto via the power source wiring 511*d* and the third high-side transistor 341*c* from the auxiliary power source circuit 50 and the capacitor C3.

Figure 12B:
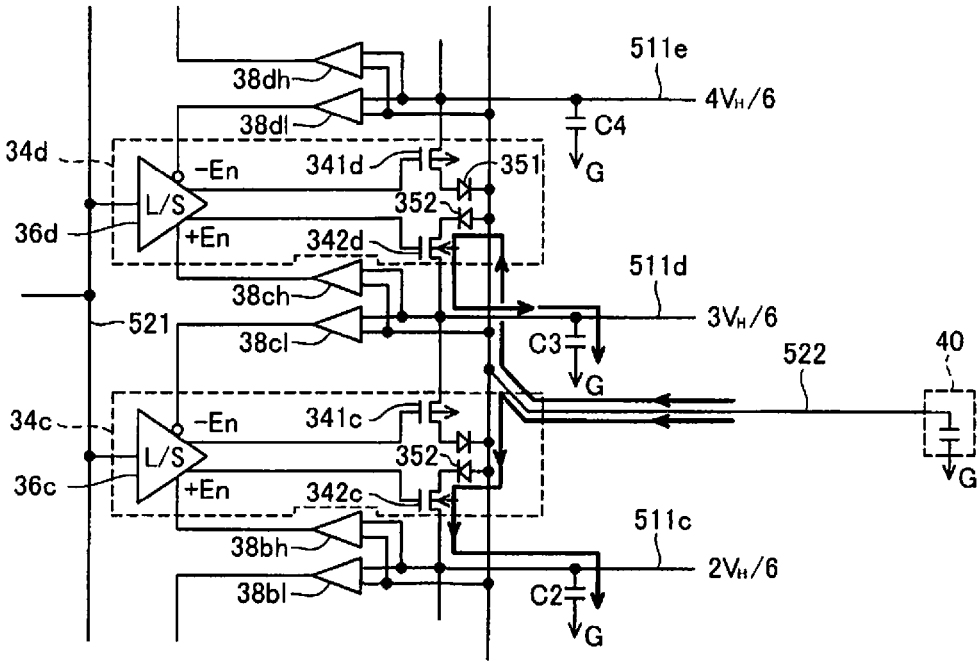

FIG. 12B is a descriptive drawing for describing the flow of the current during discharging. The flow of the current for when the output voltage Vout is $3V_H/6$ and the input voltage Vin is less than the output voltage Vout shall be described herein, as one example. In the driver, the respective low-side transistors (the third low-side transistor 342*c* and the fourth low-side transistor 342*d*) of the third unit amplifier circuit 34*c* and the fourth unit amplifier circuit 34*d* function, and each has flowing therethrough a current corresponding to the voltage between source and gate. Accordingly, as illustrated in FIG. 12B, the capacitor C2 is charged with a part of the current discharged from the nozzle actuator element 40, via the output wiring 522, the third low-side transistor 342*c*, and the power source wiring 511*c*, and the capacitor C2 is charged with a part thereof via the output wiring 522, the third low-side transistor 342*c*, and the power source wiring 511*c*. The energy with which the capacitor C2 is charged is utilized in charging the nozzle actuator element 40 via the second unit amplifier circuit 34*b*. For this reason, it is possible to reduce the loss of energy that occurs during charging and discharging of the nozzle actuator element 40.

According to the driver 30A of the second example, described above, the operating unit amplifier circuit 34 is switched from one unit amplifier circuit 34 to another adjacent unit amplifier circuit 34 at an output voltage Vout near to which the other unit amplifier circuit 34 begins to operate before the one unit amplifier circuit 34 stops operating, and therefore it is possible to better minimize the magnitude of the ripples included in the waveform of the drive signal aCOM in comparison to the driver 30 of the first example. For example, when the output voltage Vout rises and reaches $3V_H/6-\beta$, the fourth unit amplifier circuit 34*d* begins to operate while the third unit amplifier circuit 34*c* also remains operating. The speed of rising of the output voltage Vout in the third unit amplifier circuit 34*c* does lower when the output voltage Vout approaches $3V_H/6$, but because the fourth unit amplifier circuit 34*d* is operating, the occurrence of lowering of the slope of the rising portion RE is suppressed. That is to say, the magnitude of the ripples Pr near $3V_H/6$ is minimized. The magnitude of the ripples that occur near $3V_H/6$ is also suppressed for a similar reason for the falling portion of the waveform of the drive signal aCOM, as well.

D. Third Example of Driver 30

Compared to the driver 30A of the second example, a driver 30B of the third example is different in terms of the amount of shift in the voltage outputted to the transistors 341, 342 by the level shifters 36. The circuitry configuration of the driver 30B of the third example is similar to the circuitry configuration of the driver 30A (FIG. 10) of the second example. The level shifters 36 of the third example, when in the enable state, shift the inputted input voltage Vin by the predetermined value $\alpha$ in the minus direction (Vin$-\alpha$) and supply same to the gate terminals of the high-side transistors 341, and shift the input voltage Vin by the predetermined value $\alpha$ in the plus direction (Vin$+\alpha$) and supply same to the gate terminals of the low-side transistors 342. That is to say, in the driver 30B of the third example, a current flows to both the high-side transistors 341 and the low-side transistors 342 when the difference between the input voltage Vin and the output voltage Vout is within $\pm\alpha$ ($|Vin-Vout|\leq\alpha$). That is to say, a through current flows from the drains of the high-side transistors 341 to the sources of the low-side transistors 342 by way of the diodes 351, the output wiring 522, and the diodes 352.

Figure 13A:
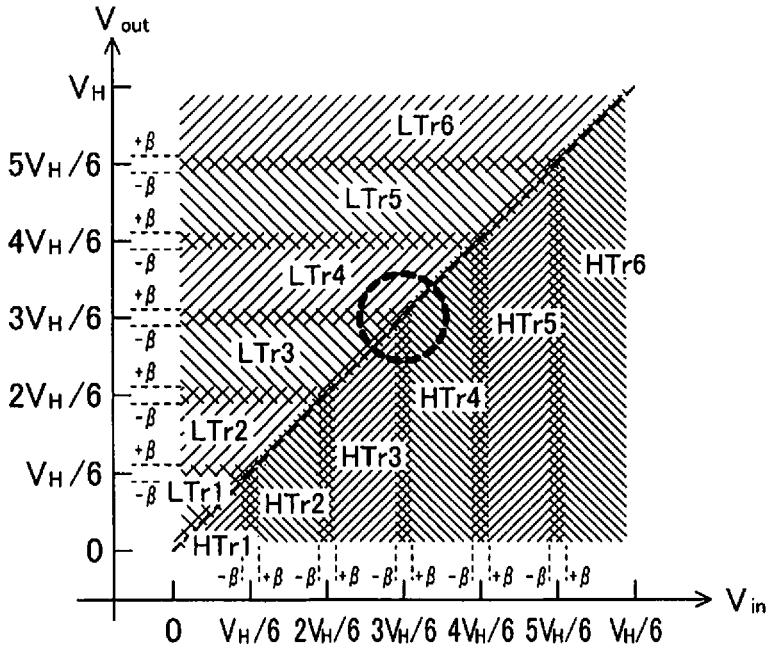
FIGS. 13A and 13B are descriptive drawings for describing a relationship to the operating state of a transistor in a driver in the third example.
Figure 13B:
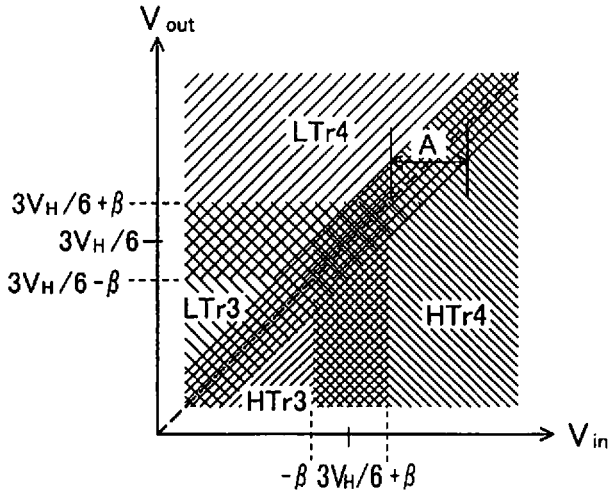

FIG. 13 is a descriptive drawing for describing a relationship to the operating state of the transistors in the driver of the third example. FIG. 13 corresponds to FIG. 11 of the second example. The plurality of hatchings illustrated in FIGS. 13A and 13B indicate the operating regions of each of the transistors 341*a* to 341*f*, 342*a* to 342*f*. The driver 30B of the third example has partial overlap between the operating regions of the high-side transistors 341 included in two mutually adjacent unit amplifier circuits 34, and between the operating regions of the low-side transistors 342 included in two mutually adjacent unit amplifier circuits 34, similarly with respect to the driver 30A of the second example. The driver 30B of the third example also has partial overlap between the operating region of an high-side transistor 341 and operating region of an low-side transistor 342 that are included in the same unit amplifier circuit 34. In FIG. 13, the portions where the operating regions overlap have overlaid hatching and are thus represented with cross-hatching.

FIG. 13B is a drawing enlarging the periphery of the portion illustrated with a dashed-line circle in FIG. 13A. As illustrated in FIG. 13B, an overlap width A between the operating region of the high-side transistors 341 and the operating region of the low-side transistors 342 is proportional to the amount of shifting by the level shifters 36 and is $A=2\alpha$. Having there be overlap between the operating regions of the high-side transistors 341 and the operating regions of the low-side transistors 342 makes it possible to eliminate a state where both the high-side transistor 341 and the low-side transistor 342 stop when the input voltage Vin and the output voltage Vout are substantially equal. For this reason, it is possible to minimize the magnitude of the curved parts Pc included in the drive signal aCOM. Because the curved parts Pc can be considered to be one aspect of the ripples Pr, the magnitude of the ripples Pr can be further minimized according to the driver 30B. The driver 30B of the present example is, however, configured so that that working regions of four transistors (the two high-side transistors 341 and two low-side transistors 342) in two adjacent unit amplifier circuits 34 have partial overlap.

According to the driver 30B of the third example, described above, the voltage gap GP (FIG. 7) is not present between the working regions of the high-side transistors 341 and the working regions of the low-side transistors 342, and therefore having the input voltage Vin and the output voltage Vout be positioned near the voltage gap GP makes it possible to suppress the formation of the curved parts Pc in the waveform of the drive signal aCOM.

E. Fourth Example of Driver 30

Figure 14:
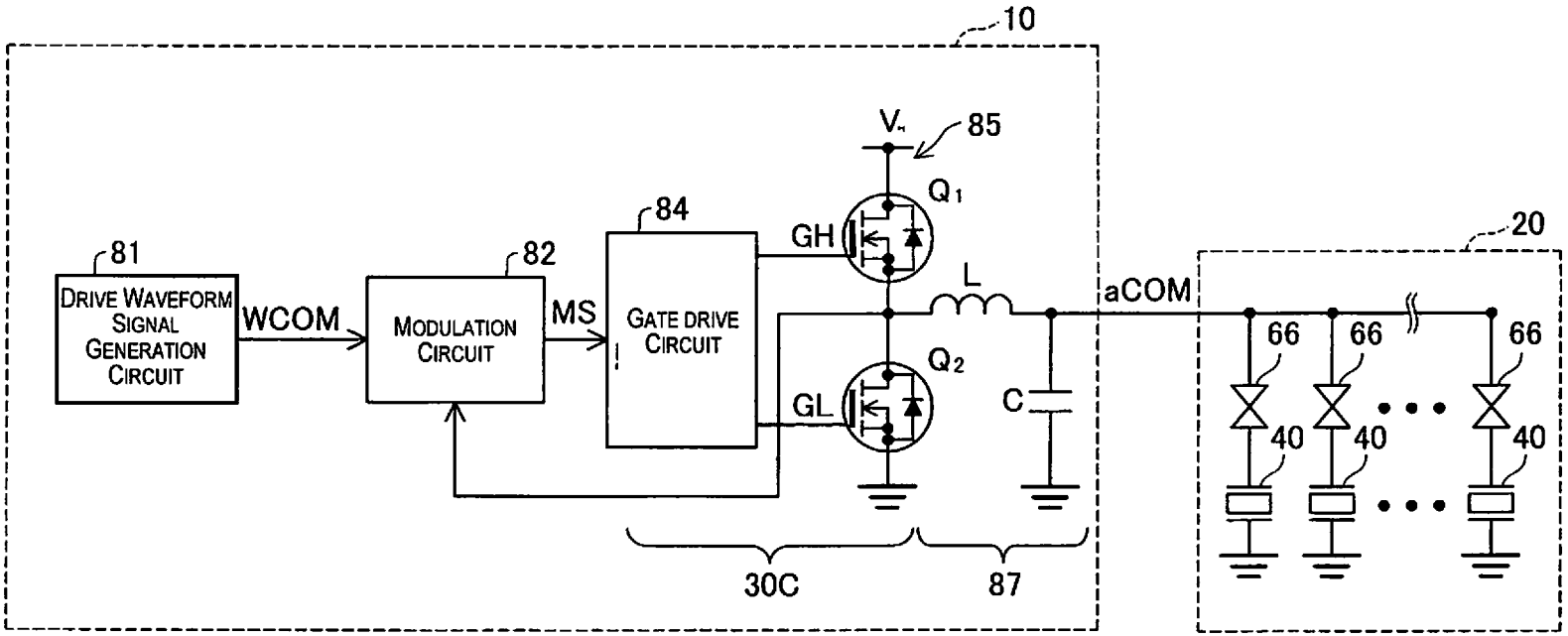
FIG. 14 is a descriptive drawing illustratively exemplifying a schematic configuration of a driver serving as a fourth example.

FIG. 14 is a descriptive drawing illustratively exemplifying a schematic configuration of a printer comprising a driver serving as a fourth example. A driver 30C of the fourth example is a class D current amplifier circuit. The control unit 10 of the fourth example includes a drive waveform signal generation circuit 81, a modulation circuit 82, the driver 30C, and a smoothing filter 87. The drive waveform signal generation circuit 81 generates a drive waveform signal WCOM serving as a reference for the drive signal aCOM. The modulation circuit 82 pulse-modulates the drive waveform signal WCOM generated in the drive waveform signal generation circuit 81, and outputs a modulation signal MS.

The driver 30C current-amplifies the modulation signal MS outputted from the modulation circuit 82, and outputs a current-amplified modulation signal. The driver 30*c* is provided with a half-bridge output stage 85 composed of two switching elements (a high-side switching element Q1 and a low-side switching element Q2) for amplifying the current, and a gate drive circuit 84 for adjusting gate-source signals GH and GL of the switching elements Q1 and Q2 on the basis of the modulation signal MS coming from the modulation circuit 82. In the driver 30C, when the modulation signal MS is at a high level, the high-side switching element Q1 enters an on state, with the gate-source signal GH being at the high level, and the low-side switching element Q2 enters an off state, with the gate-source signal GL being at a low level. As a result, the output of the half-bridge output stage 85 is the voltage $V_H$. In turn, when the modulation signal MS is at the low level, the high-side switching element Q1 enters an off state, with the gate-source signal GH at the low level, and the low-side switching element Q2 enters an on state, with the gate-source signal GL at the high level. As a result, the output of the half-bridge output stage 85 is zero. In this manner, with the driver 30C, the current is amplified by switching operations of the high-side switching element Q1 and the low-side switching element Q2 based on the modulation signal MS. The smoothing filter 87 smooths the current-amplified modulation signal outputted from the driver 30C, generates the drive signal aCOM, and supplies same to the nozzle actuator element 40 via a selection switch 66 of the print head 20.

According to the driver 30C of the fourth example, described above, the class D amplifier circuit, which is a non-linear amplifier circuit, is used to amplify the current of the drive signal, and therefore it is possible to form the ripples in the waveform of the drive signal aCOM. Also, because the driver 30C is a non-linear amplifier circuit, the printer provided with the driver 30C makes it possible to suppress power consumption better than a printer provided with a linear amplifier circuit.

F. Examples of Modification

The present invention is not to be limited to the embodiments described above; rather, the present invention can be implemented in a variety of different embodiments within a scope that does not depart from the spirit thereof. For example, modifications as per the following would also be possible.

F-1. Modification Example 1

The driver 30 illustrated as the first through fourth examples is one example of an amplifier circuit with which the waveform of the drive signal aCOM includes the ripples Pr, but the drivers provided to the printer 1 are not limited to being the circuitry configurations illustrated in the above examples. That is to say, the printer 1 can employ any desired drivers, with which the waveform of the drive signal aCOM includes the ripples Pr. For example, the amplifier circuits disclosed in Japanese Patent Application 2012-10660 or Japanese Patent Application 2012-10662 may be used as the drivers 30. The ripples Pr included in the waveform of the drive signal aCOM may also, however, include ripples other than ripples that are caused by the properties of the amplifier circuit. For example, the ripples Pr included in the waveform of the drive signal aCOM may include ripples formed by the impact of fluctuations in the voltage value of the power supplied to the printer 1, the magnetic force around the printer 1, or the like.

F-2. Modification Example 2

The circuitry configuration of the driver 30 illustrated in the first through third examples can be altered as appropriate. For example, instead of MOSFETs, bipolar transistors may be used as the transistors 341, 342. The number of unit amplifier circuits 34 provided to the driver 34 is also not limited to being six, and can be any desired number.

F-3. Modification Example 3

Figure 15:
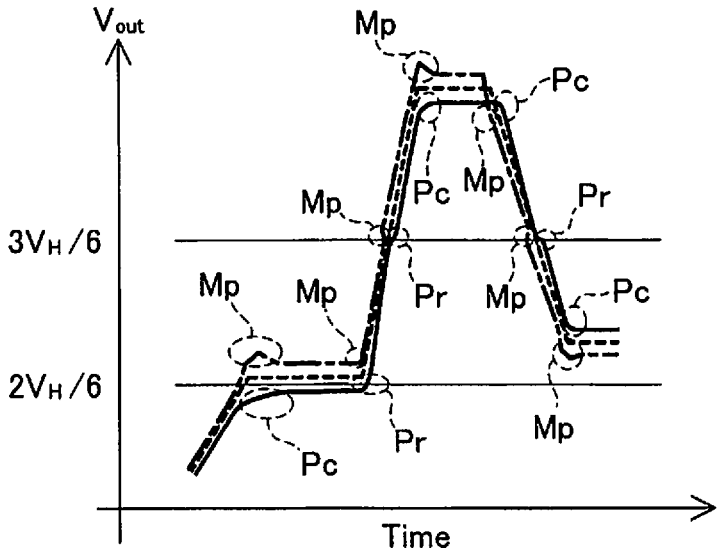
FIG. 15 is a descriptive drawing illustratively exemplifying an original drive signal COM in an example of modification.

FIG. 15 is a descriptive drawing for describing the waveform of the original drive signal COM in a modification example. FIG. 15 illustrates the waveform of the original drive signal COM of the present modification example with an alternatingly dotted and dashed line, and, as references, illustrates the waveform of the original drive signal COM of the first embodiment with a dashed line and illustrates the waveform of the drive signal aCOM of the first embodiment with a solid line. For the original drive signal COM as in the modification example, the original drive signal COM of the first embodiment is subjected to waveform correction (pre-emphasis). More specifically, with the original drive signal COM as in the modification example, enhanced parts Mp are formed so as to cancel out the ripples Pr and the curved parts Pc in advance in a portion corresponding to the portions where the ripples Pr and curved parts Pc are created in the waveform of the drive signal aCOM. When the original drive signal COM in which the enhanced parts Mp are formed is current-amplified by the driver 30, then the ripples Pr and curved parts Pc and the enhanced parts Mp cancel each other out, and therefore it is possible to minimize the magnitude of the ripples Pr and the curved parts Pc in terms of the outer shape of the waveform of the drive signal aCOM thus generated. With the method of such description, it is still also possible to adjust the magnitude of the ripples Pr and the curved parts Pc formed in the waveform of the drive signal aCOM.

F-4. Modification Example 4

The components of the ink illustrated in the first embodiment are one example of the components contained in an ink that can be applied to the printer 1, and the components contained in the inks to which the printer 1 can be applied are not limited to being the components illustrated in the first embodiment. That is to say, the printer 1 allows for the use of any desired ink that contains 0.1 wt % to 10 wt % in polar solvent. The specific components of the polar solvent contained in the ink are also not limited to being those in the first embodiment, nor are the components other than the polar solvent.

F-5. Modification Example 5

The present invention can also be applied to an apparatus other than an inkjet printer, provided that the apparatus be one that discharges a liquid (including a liquid body that has particles of a functional material dispersed therein, or a fluid body such as a gel). Possible examples as the liquid discharge apparatus of such description include: a textile printing apparatus for attaching a pattern to a fabric; an apparatus for spraying ink containing a dispersed or dissolved form of a material such as a coloring or electrode material used to produce a liquid crystal display, electroluminescence (EL) display, surface emitting display, or color filter or the like; an apparatus for discharging a biological organic material used to produce biochips; an apparatus for discharging a liquid to serve as a reagent used as a precision pipette; an apparatus for discharging a lubricating oil at pin points for a precision machine such as a timepiece or camera; an apparatus for discharging, onto a substrate, a transparent resin solution such as an ultraviolet ray-curable resin for forming, inter alia, a hemispherical micro lens (optical lens) used in an optical communication element or the like; a device for discharging an etching solution such as an acid or alkali in order to etch a substrate or the like; or the like.

Also, a part of the configuration that in the first embodiment was achieved by hardware may be substituted with software, or, conversely, a part of the configuration that was achieved by software may be substituted with hardware.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid discharge apparatus comprising:

an actuator element configured and arranged to receive a drive signal to discharge a liquid, the liquid being an ink including 0.1 wt % to 10 wt % of a polar solvent, a waveform of the drive signal supplied to the actuator element including non-rectangular shaped pulses having a plurality of shapes with a ripple being formed in a falling portion of the non-rectangular shaped pulse, the drive signal supplied to the actuator element being obtained by subjecting an original drive signal to non-linear current amplification.

2. The liquid discharge apparatus as set forth in claim 1, further comprising an auxiliary power source circuit serving as a power supply source, and an amplifier circuit configured to use power supplied from the auxiliary power source circuit to current-amplify an inputted original drive signal and generate the drive signal, wherein the amplifier circuit is configured to current-amplify the original drive signal, with which the ripple is not formed in the waveform, to generate the drive signal with which the ripple is formed in the waveform.

3. The liquid discharge apparatus as set forth in claim 2, wherein the amplifier circuit includes a plurality of unit amplifier circuits respectively connected to both the auxiliary power source circuit and the actuator element, and among the unit amplifier circuits, one or two unit amplifier circuits are configured to supply a current to the actuator element using the auxiliary power source circuit as a source of supply of the current, in accordance with a voltage of a side that is connected to the actuator element.

4. The liquid discharge apparatus as set forth in claim 2, wherein the amplifier circuit is a class D amplifier circuit.

5. The liquid discharge apparatus as set forth in claim 1, wherein the ink includes hexanediol.

6. The liquid discharge apparatus as set forth in claim 1, wherein the ink includes at least a colorant, a photopolymerizable resin, a photopolymerization initiator, and the polar solvent, the photopolymerizable resin includes oligomer particles in an emulsion state and monomer present in the oligomer particles, and the polar solvent includes one or more species among 2-pyrrolidone, N-acryloyl morpholine, and N-vinyl-2-pyrrolidone.

7. A method of discharging a liquid comprising:

discharging a liquid by supplying a drive signal to an actuator element, the liquid being an ink comprising 0.1 wt % to 10 wt % of a polar solvent, a waveform of the drive signal supplied to the actuator element including non-rectangular shaped pulses having a plurality of shapes with a ripple being formed in a falling portion of the non-rectangular shaped pulse, the drive signal supplied to the actuator element being obtained by subjecting an original drive signal to non-linear current amplification.

* * * * *